US007175252B2

(12) United States Patent
Sonobe

(10) Patent No.: US 7,175,252 B2
(45) Date of Patent: Feb. 13, 2007

(54) INK JET PRINTING APPARATUS AND EJECTION RECOVERY METHOD FOR PRINTING HEAD

(75) Inventor: Yoichi Sonobe, Chiba (JP)

(73) Assignee: Canon Finetech Inc., Joso (JP)

( * ) Notice: Subject to any disclaimer, the term of this patent is extended or adjusted under 35 U.S.C. 154(b) by 262 days.

(21) Appl. No.: 10/670,189

(22) Filed: Sep. 26, 2003

(65) Prior Publication Data

US 2004/0207683 A1 Oct. 21, 2004

(30) Foreign Application Priority Data

Sep. 30, 2002 (JP) ..... 2002-285182

(51) Int. Cl.
*B41J 2/165* (2006.01)

(52) U.S. Cl. ..... 347/23; 347/19; 347/22

(58) Field of Classification Search ..... 347/23
See application file for complete search history.

(56) References Cited

U.S. PATENT DOCUMENTS 5,583,547 A * 12/1996 Gast et al. ..... 347/22
6,033,051 A 3/2000 Kaneko
6,231,156 B1 * 5/2001 Ono ..... 347/24
6,382,764 B1 * 5/2002 Shimoda ..... 347/23

FOREIGN PATENT DOCUMENTS

JP 8-132648 5/1996

* cited by examiner

*Primary Examiner*—Vip Patel
*Assistant Examiner*—Brian J. Goldberg
(74) *Attorney, Agent, or Firm*—Fitzpatrick, Cella, Harper & Scinto

(57) ABSTRACT

An example conventional method of avoiding a printing failure caused by residual bubbles in a print head involves counting from an initiation of a printing operation the accumulated number of print dots formed by the entire print head and, when the count value reaches a predetermined value, executing a recovery operation. Such a conventional method, however, requires the recovery operation to be performed frequently by selecting a threshold value for the worst condition. To solve this problem, the nozzles in the long print head are divided into a plurality of blocks, the accumulated number of print dots is counted for each block, the count value multiplied by a weighting value, which is determined according to the position of the block, is compared with a predetermined threshold, and, when at least one of the weighted count values exceeds the predetermined threshold, the recovery operation is executed.

4 Claims, 14 Drawing Sheets

| IN-APPARATUS TEMPERATURE | BLOCK 1 | BLOCK 2 | BLOCK 3 | BLOCK 4 | BLOCK 5 | BLOCK 6 | BLOCK 7 | BLOCK 8 | BLOCK 9 | BLOCK 10 |
|---|---|---|---|---|---|---|---|---|---|---|
| ≧30℃ | 5.0 | 1.8 | 1.4 | 1.2 | 1.1 | 1.1 | 1.2 | 1.4 | 1.8 | 5.0 |
| ≧15℃ | 4.0 | 1.6 | 1.3 | 1.1 | 1.0 | 1.0 | 1.1 | 1.3 | 1.6 | 4.0 |
| <15℃ | 3.0 | 1.4 | 1.2 | 1.0 | 1.0 | 1.0 | 1.0 | 1.2 | 1.4 | 3.0 |

FIG.13

INK JET PRINTING APPARATUS AND EJECTION RECOVERY METHOD FOR PRINTING HEAD

This application claims priority from Japanese Patent Application No. 2002-285182 filed Sep. 30, 2002, which is incorporated hereinto by reference.

BACKGROUND OF THE INVENTION

1. Field of the Invention

The present invention relates to an ink jet printing apparatus and a method for a print head recovery.

2. Description of the Related Art

An ink jet printing apparatus performs a printing operation by ejecting ink onto a print medium from an array of nozzles in a print head. A variety of methods are available for ejecting ink from the nozzles. Typical methods include a bubble-jet printing method and a piezoelectric method. The bubble-jet printing method energizes heaters provided one in each of the nozzles according to drive pulses to generate and apply a heat energy to ink in each nozzle, forming a bubble in ink in the nozzle through film boiling so that the bubble as it expands in the nozzle expels by its pressure a predetermined amount of ink from the nozzle. The bubble-jet printing method, however, has a drawback that, when ink is ejected, a part, though small, of the bubble that was generated by film boiling may remain in an ink path. This residual bubble is moved along the flow of ink and accumulated in an ink chamber. Each time the ejection operation is performed, a residual bubble accumulates. As the printing operation continues, the volume of accumulated residual bubbles increases, with small bubbles combining together into larger ones.

When the residual bubbles exceed a certain volume, a printing failure occurs. For example, a residual bubble that has grown large in the ink chamber interferes with a smooth flow of ink and may prevent the ink from being supplied well to the nozzle side, resulting in an ejection failure. Conventional measures to cope with such a printing failure include the following recovery operation.

This recovery operation involves counting the number of ejections executed after the start of a printing operation to determine the accumulated number of ejections for each print head and, when the accumulated number of ejections reaches a predetermined value, temporarily stopping the printing operation to perform a variety of recovery operations such as an ink suction operation and a preliminary ejection operation (see Japanese Patent Application Laying-Open No. 8-132648 (1996)).

As described above, the conventional recovery operation determines an execution of the recovery operation based on the accumulated number of ejections for the entire print head. However, depending on a structure of the ink chamber in the print head, some of the nozzles in the print head easily build up bubbles while others do not. In other words, bubbles do not accumulate uniformly over the entire print head. More specifically, those nozzles close to an ink supply port do not easily build up bubbles. Since the residual bubbles produced in the nozzles near the ink supply port are carried away by the ink being supplied from the ink supply port, the residual bubbles tend to accumulate more at locations farther away from the ink supply port. And at ends of the nozzle column, the portions which are farthest from the ink supply port, the residual bubbles are most likely to build up.

In a long print head such as a full-line head, only a part of nozzles of the print head may be used frequently depending on an image pattern being printed. Even if the total number of ejections for the print head as a whole is small, those nozzles that are put to concentrated use develop large bubbles, causing ejection failures.

Despite the fact that the buildup of residual bubbles varies according to the nozzle positions and that not all the nozzles of the print head are operated uniformly, the prior art executes the recovery operation when the total number of ejections for the print head as a whole reaches a predetermined threshold value. As a result, the recovery operation cannot in some cases be performed at an appropriate timing. To alleviate this problem it has been a conventional practice to determine the threshold value by performing printing operations under a variety of conditions that cause printing failures and which change depending on the liquid chamber structure in the print head and an image pattern being printed, and then selecting a threshold value for the worst condition. This requires the recovery operation to be performed frequently and ink is therefore wasted.

SUMMARY OF THE INVENTION

The present invention has been accomplished in light of the problems of the prior art described above and it is an object of this invention to provide an ink jet printing apparatus and a recovery operation method that allow the recovery operation to be executed at an appropriate timing and can keep an ejection state of a print head in good condition at all times and suppress wasteful consumption of ink.

To achieve the above objective, this invention provides an ink jet printing apparatus to form an image on a print medium by ejecting ink onto the print medium from a plurality of nozzles arrayed in a print head, the printing apparatus comprising: a recovery means to recover a normal ink ejection state of each nozzle in the print head; and a recovery operation determining (judging or checking) means for dividing the nozzles into a plurality of blocks, counting the number of ejections from the nozzles in each block and, based on the accumulated number of ejections for each block, determining whether or not to execute a recovery operation of the recovery means.

By dividing the print head into blocks of two or more nozzles, counting the accumulated number of ejections for each block, and executing the recovery operation based on the count values as described above, it is possible to perform the recovery operation at an appropriate timing.

Further, since the recovery operation is executed when at least one of the count values for the individual blocks reaches a predetermined threshold, the recovery operation can be performed just as many times as required.

Further, when the count value multiplied by a weighting value, which increases as the block is farther away from the ink supply port of the print head, exceeds the predetermined threshold, the recovery operation is executed. Therefore, despite the fact that residual bubbles build up to different degrees at different nozzle positions, it is possible to execute the recovery operation at a timing that best matches the associated nozzle position.

In addition, by changing the weighting value according to a temperature in the ink jet printing apparatus, the recovery operation can be performed always at an appropriate timing in any operation environment.

Since the recovery operation can be performed at an appropriate timing as described above, the number of times that the recovery operation is executed can be reduced and therefore a wasteful consumption of ink suppressed, when compared with the prior art.

The above and other objects, effects, features and advantages of the present invention will become more apparent from the following description of embodiments thereof taken in conjunction with the accompanying drawings.

BRIEF DESCRIPTION OF THE DRAWINGS

FIG. 13 is a table showing weighting values according to an in-apparatus temperature in a second embodiment.

DETAILED DESCRIPTION OF PREFERRED EMBODIMENTS

Embodiments of the present invention will be described by referring to the accompanying drawings.

(Embodiment 1)

Figure 1:
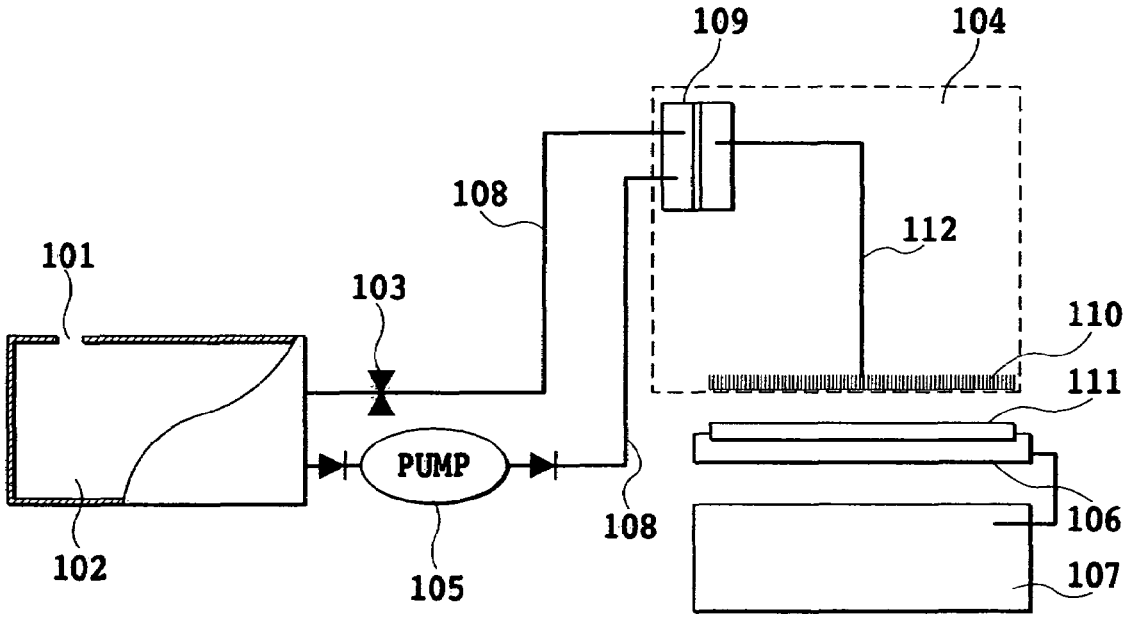
FIG. 1 is a schematic diagram showing an ink path in an ink jet printing apparatus according to a first embodiment of the present invention.

FIG. 1 is a schematic diagram showing a flow of ink in an ink jet printing apparatus. Designated 102 is an ink cartridge for accommodating ink therein. Denoted 101 is an air communication port to communicate an interior of the ink cartridge 102 with an open atmosphere. Reference number 103 represents a recovery valve which is closed during the recovery operation to block a return of ink from a print head to the ink cartridge during the recovery operation. Denoted 104 is a print head formed with a plurality of nozzles 110 to eject ink. A pump 105 delivers ink from the cartridge to the print head. A capping mechanism 106 covers a nozzle face of the print head during the recovery operation. Ink is discharged into this capping mechanism 106 during a preliminary ejection. The capping mechanism 106 also sucks out residual bubbles and viscous ink from the nozzles in the print head. A waste ink tank 107 accommodates waste ink that was collected in the capping mechanism 106. An ink path 108 provides a passage in which ink is delivered from the ink cartridge 102 to the print head 104 or vice versa. A filter 109 removes foreign matter from the ink supplied from the ink cartridge and also returns the filtered ink to the ink cartridge 102. An ink supply path 112 provides a passage in which ink that was delivered from the ink cartridge 102 is further supplied through the filter 109 to the nozzles 110. A cleaning blade 111 wipes clean the nozzle face of the print head 104.

When the recovery valve 103 is open, the ink circulates without passing through the filter 109 and returns to the ink cartridge 102.

When the recovery valve 103 is closed, the ink on the print head 104 side cannot return to the ink cartridge 102.

Ink discharged from the nozzles 110 as by preliminary ejection or sucking operation during the recovery operation is temporarily held in an ink reservoir in the capping mechanism 106 and then absorbed into the waste ink tank 107 below. At this time, ink that remained near the nozzles of the print head is wiped off by the cleaning blade 111 made of an elastic member and installed in a recovery trough of the capping mechanism 106.

During a printing operation, nozzle heaters (not shown) provided one in each nozzle are selectively energized to eject ink from the corresponding nozzles onto a print medium, thus forming an image on the print medium.

To obtain stable ejections, the nozzles need to be kept at a negative pressure. This negative pressure can be maintained by a different level of water between the print head and the ink cartridge, which is produced by setting an ink level in the ink cartridge 102 lower than the nozzle face of the print head and providing the air communication port 101.

The print head in this embodiment is a full-line head spanning a full width of the print medium in a direction perpendicular to the print medium feeding direction. The print head has its nozzle array arranged to fully cover the width of the print medium. During printing, the ink ejection from the print head and the feeding of the print medium by a predetermined distance are alternated to form an image over an entire surface of the print medium.

Figure 2A:
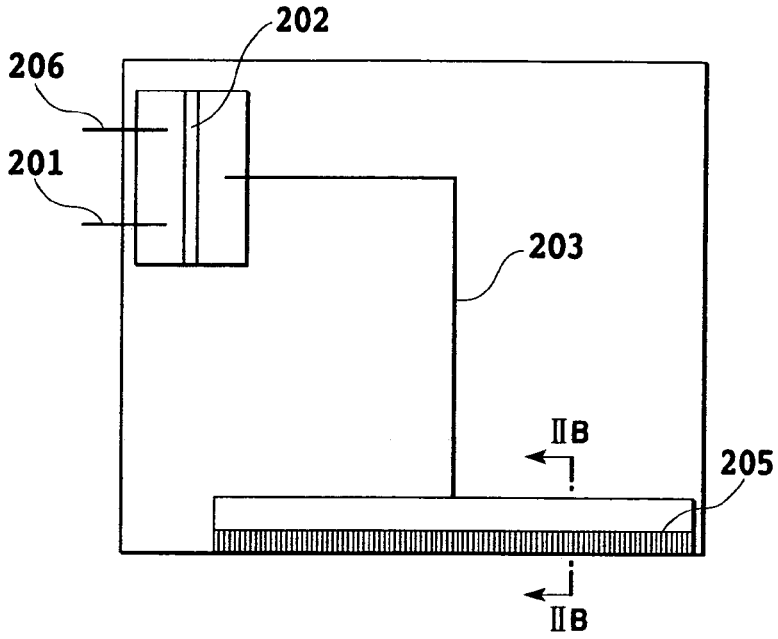
FIG. 2A is a schematic diagram showing a construction of a print head.
Figure 2B:
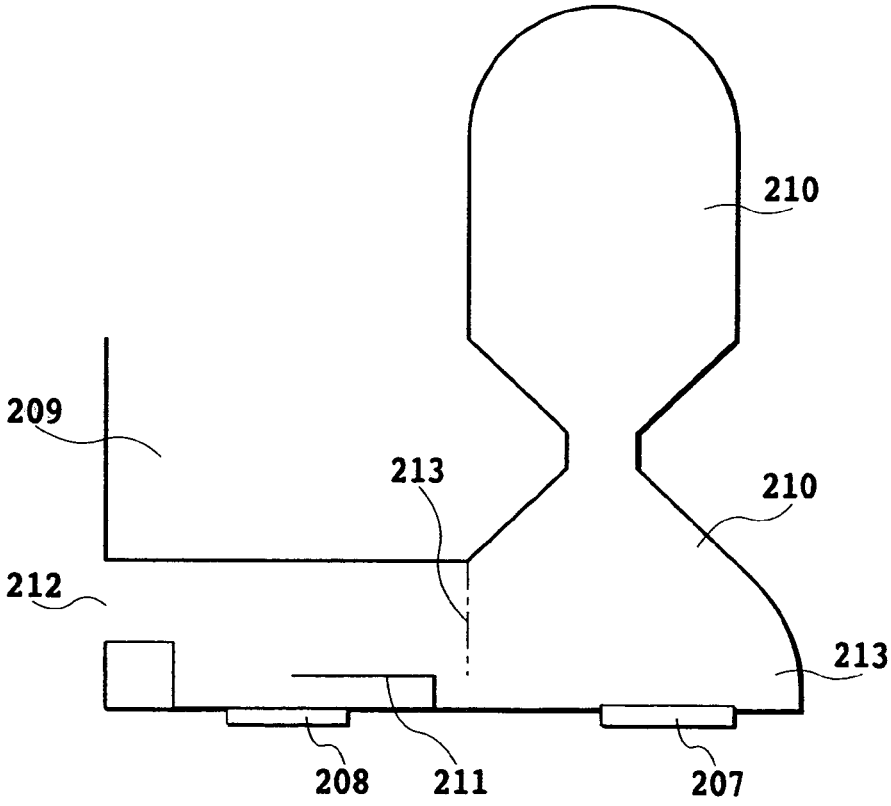
FIG. 2B is a cross-sectional view taken along the line IIB—IIB of FIG. 2A.

FIG. 2A is a schematic diagram showing a print head. FIG. 2B is a cross section taken along the line IIB—IIB of FIG. 2A.

As shown in FIG. 2B, a heating body (or heater) 208 is provided in each of the nozzles in the print head 104. When ink is to be ejected, the heater 208 is energized to heat ink and generate a bubble which, as it expands, expels a predetermined volume of ink.

The nozzles correspond to ink paths each of which is formed by a substrate having the heaters 208 embedded therein, a top plate 209 joined to the substrate, a common liquid chamber 210 from which ink is supplied to each nozzle, a valve 211 for directing a generated bubble toward the ejection direction to eject ink efficiently, and an ejection port 212.

Selectively applying a pulse voltage to the desired heaters 208 installed in the nozzles results in the ink near the energized heaters instantly boiling and being ejected from the ejection ports 212 by a pressure of generated bubbles.

The top plate 209 is used to form the common liquid chamber 210, from which the ink is supplied to individual paths leading to the heaters 208. The top plate 209 has integrally formed path walls 213 which extend from a ceiling portion down between the heaters.

A subheater 207 is an electric resistance layer (heating body) of relatively large capacity and is installed not for each nozzle but at predetermined intervals and used to control a temperature of the print head as a whole including the common liquid chamber.

Next, how residual bubbles are generated will be explained.

FIG. 3A to FIG. 3D illustrate a process in which residual bubbles are formed.

Figure 3A:
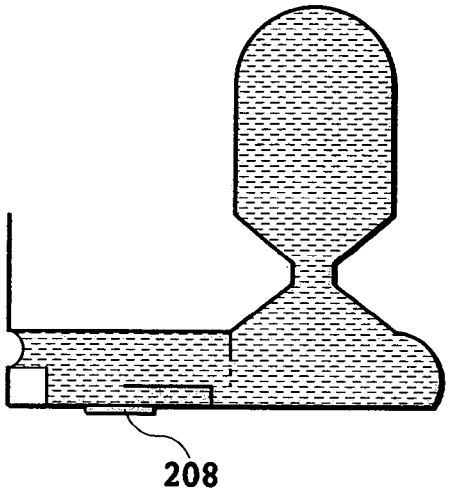
FIG. 3A is a schematic diagram showing how a residual bubble is produced in the print head.
Figure 3B:
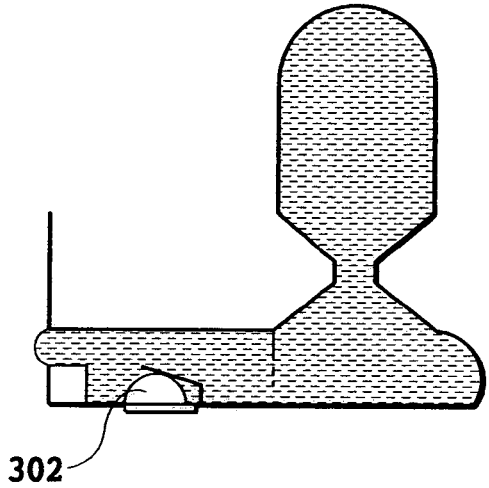
FIG. 3B is a schematic diagram showing how a residual bubble is produced in the print head.
Figure 3C:
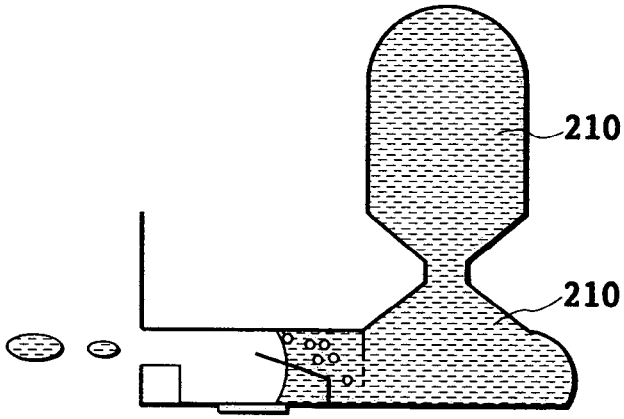
FIG. 3C is a schematic diagram showing how a residual bubble is produced in the print head.
Figure 3D:
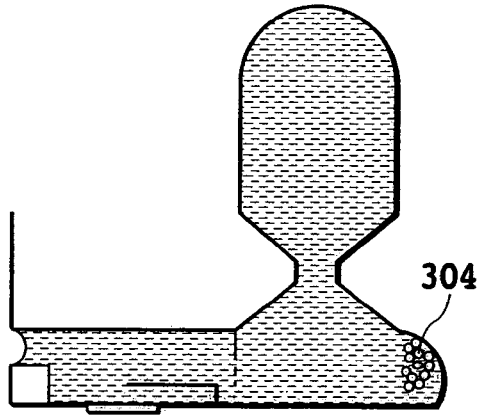
FIG. 3D is a schematic diagram showing how a residual bubble is produced in the print head.

When a pulse voltage is applied to a heater 208 (see FIG. 3A), ink near the heater 208 instantaneously boils to generate a bubble 302 (FIG. 3B). As the bubble inflates, the ink in a space from the ejection port to the heater is expelled (FIG. 3C). This is how the ink is ejected. Immediately after the ink has been ejected, the bubble collapses. However, when the bubble inflates, a part of the bubble separates and moves past the valve and remains in the ink. Then, when new ink is filled into an empty space ranging from the ink path to the ejection port, the residual bubbles remain in the common liquid chamber 210 because of an ink flow (FIG. 3D).

Since the residual bubbles are formed each time the ink ejection is executed, they grow gradually in the common liquid chamber.

Figure 4A:
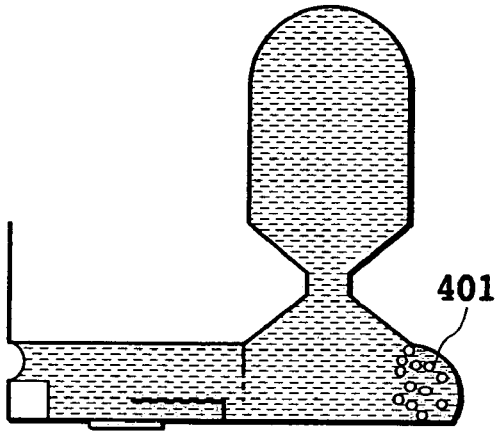
FIG. 4A is a schematic diagram showing how a residual bubble grows in the print head.
Figure 4B:
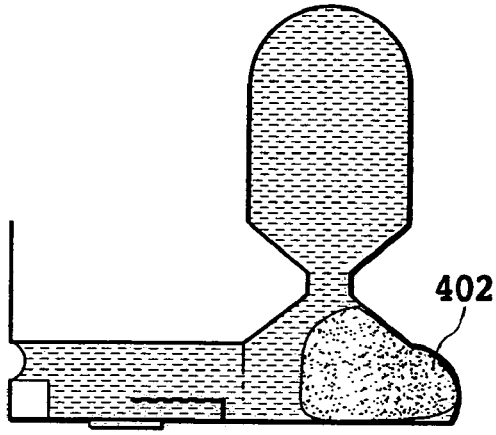
FIG. 4B is a schematic diagram showing how a residual bubble grows in the print head.
Figure 4C:
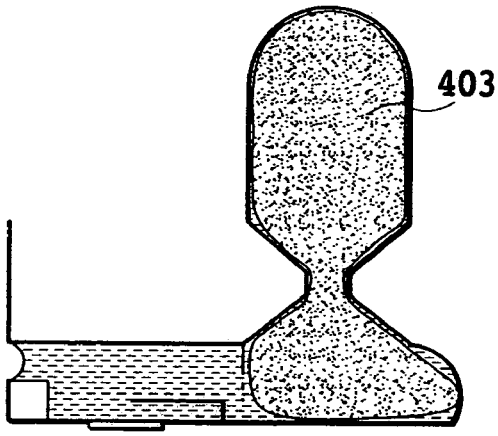
FIG. 4C is a schematic diagram showing how a residual bubble grows in the print head.

FIG. 4A to FIG. 4C show how residual bubbles grow.

Residual bubbles generated by the ink ejection remain in the common liquid chamber (see FIG. 4A). As the ink ejection is repeated, the residual bubbles combine to grow as a larger bubble (FIG. 4B). In this state, however, since an ink flow from the common liquid chamber to the ink path to the ejection port is secured, an ink supply is normally performed.

However, when, as a result of further repetition of ink ejection, a bubble 403 grows to occupy the entire common liquid chamber (FIG. 4C), an ink supply is blocked, making a normal ejection operation impossible.

To avoid this phenomenon, recovery operation to remove a residual bubble 402 from the common liquid chamber of the print head needs to be executed before the residual bubbles grow to occupy the entire common liquid chamber as shown in FIG. 4C. The recovery operation may, for example, be a preliminary ejection or a suction operation.

Further, the residual bubbles build up at a varying rate depending on nozzle positions and the number of nozzles that are activated simultaneously.

Figure 5A:
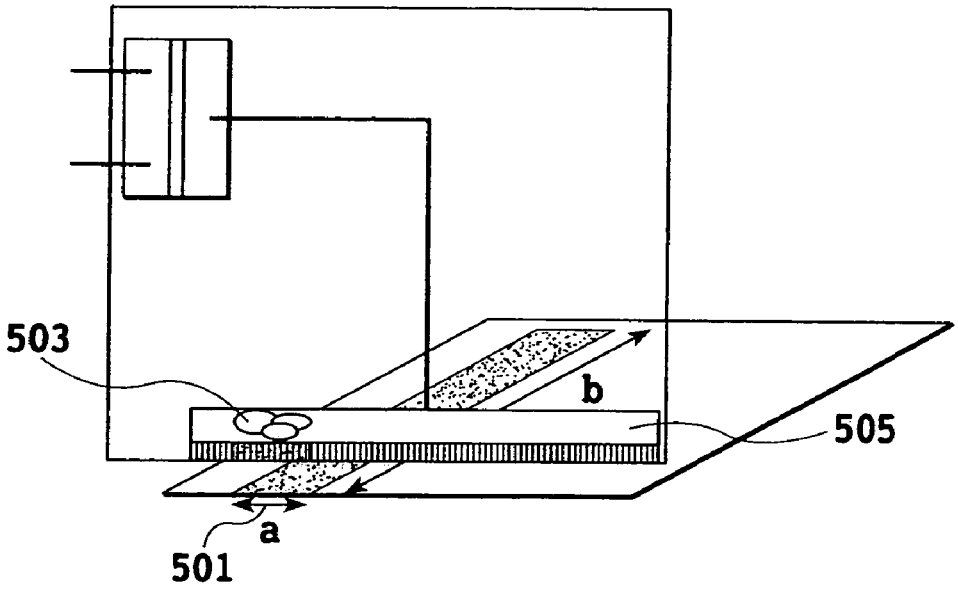
FIG. 5A is a schematic diagram showing how residual bubbles build up as related to a print pattern.

For a print pattern that requires activating only a part of the nozzles of the print head which spans a print width a, as shown in FIG. 5A, residual bubbles are formed close to only those nozzles that are ejecting ink.

Figure 5B:
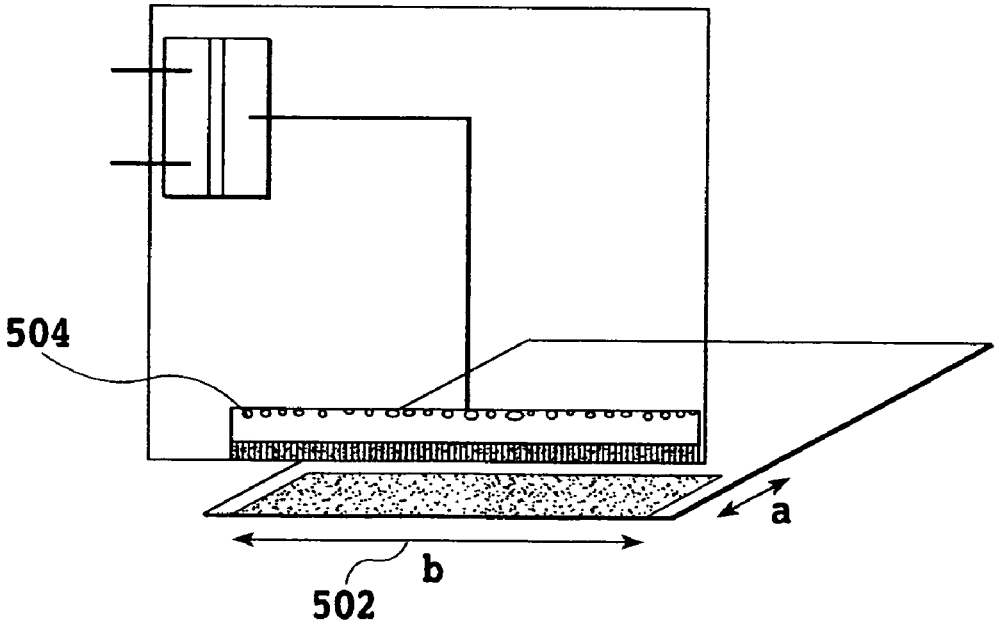
FIG. 5B is a schematic diagram showing how residual bubbles build up as related to a print pattern.

For a print pattern that requires activating all the nozzles of the print head that span a print width b, as shown in FIG. 5B, residual bubbles are formed over an entire length of the print head.

A comparison between the above two cases shows that, although the areas to be printed are both a×b, the print pattern shown in FIG. 5B does not build up large bubbles since the number of ejections from each nozzle is small, whereas the print pattern shown in FIG. 5A results in residual bubbles growing large since only a part of the nozzles are activated repetitively. Hence, although the print areas are equal, the print pattern of FIG. 5A results in an ejection failure earlier than that of FIG. 5B. As described above, with a print pattern that uses only a part of the nozzles, an ejection failure occurs even if the total number of ejections for the entire print head is small.

As described above, not all nozzles of the print head are evenly used at all times and only particular nozzles may be used concentratedly. Thus, the conventional method that counts the total number of ejections from all nozzles of the print head fails to execute the recovery operation in time. To deal with this problem, this embodiment divides the nozzles of the print head into a plurality of blocks, counts the ejection number for each block and, when the accumulated number of ejections for any block (also referred to as an "accumulated print dot number") reaches a predetermined threshold, executes the recovery operation. While in this embodiment the nozzles are grouped into blocks of two or more nozzles, other dividing configurations may also be used. For example, it is possible to count the accumulated ejection number for each nozzle and, when one of the accumulated ejection numbers reaches a predetermined threshold, execute the recovery operation. Further, the number of nozzles making up each block need not be the same for all blocks. For example, in a portion where bubbles easily build up, the nozzles may be divided into blocks of one or a few nozzles, while in a portion where bubbles do not easily build up, the number of nozzles making up each block may be set larger than that of the former portion.

Figure 6:
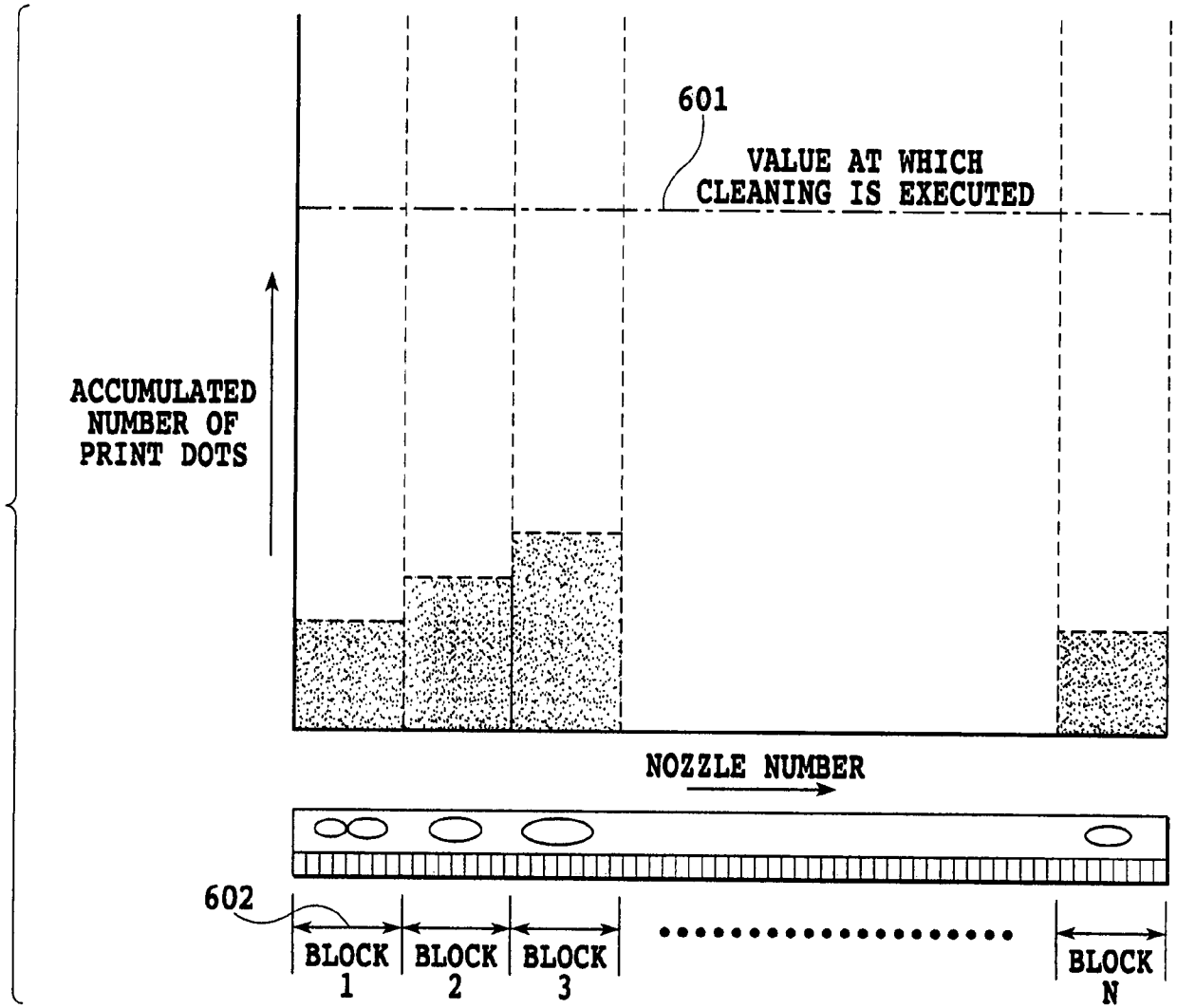
FIG. 6 is a diagram showing a relation between the accumulated number of print dots and each nozzle block according to the present invention.

As shown in FIG. 6, the print head is divided into n blocks, block 1 to block n, and the number of ejections is counted for each block. This enables the recovery operation to be executed at an appropriate timing even if a print pattern requires only a particular block of nozzles to be activated intensively.

It is assumed that the recovery operation is done by performing either a preliminary ejection operation on all nozzles of the print head or a suction operation on all nozzles.

Figure 7A:
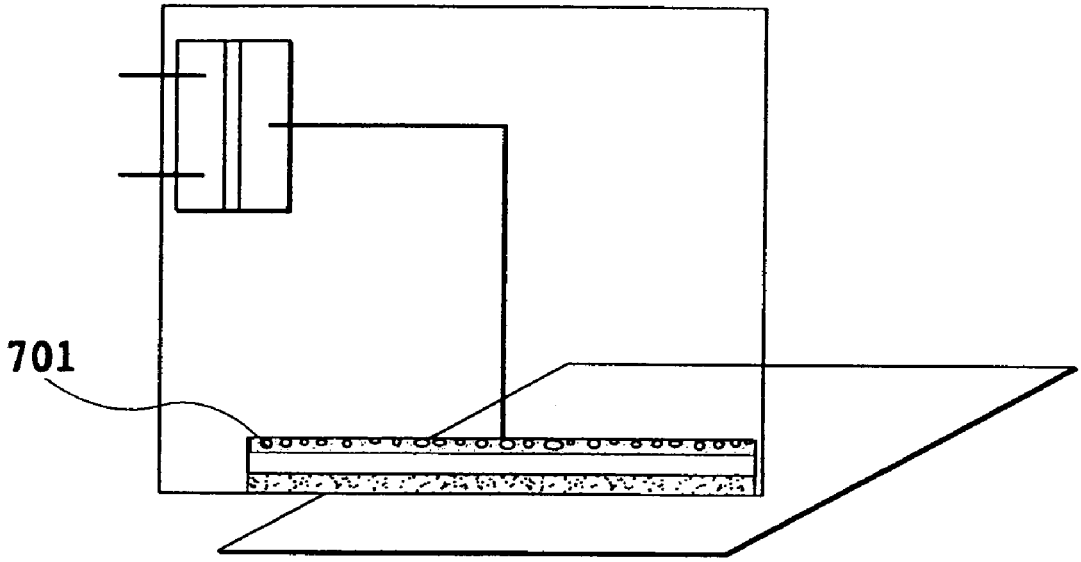
FIG. 7A is a schematic diagram showing a state in which residual bubbles are formed.
Figure 7B:
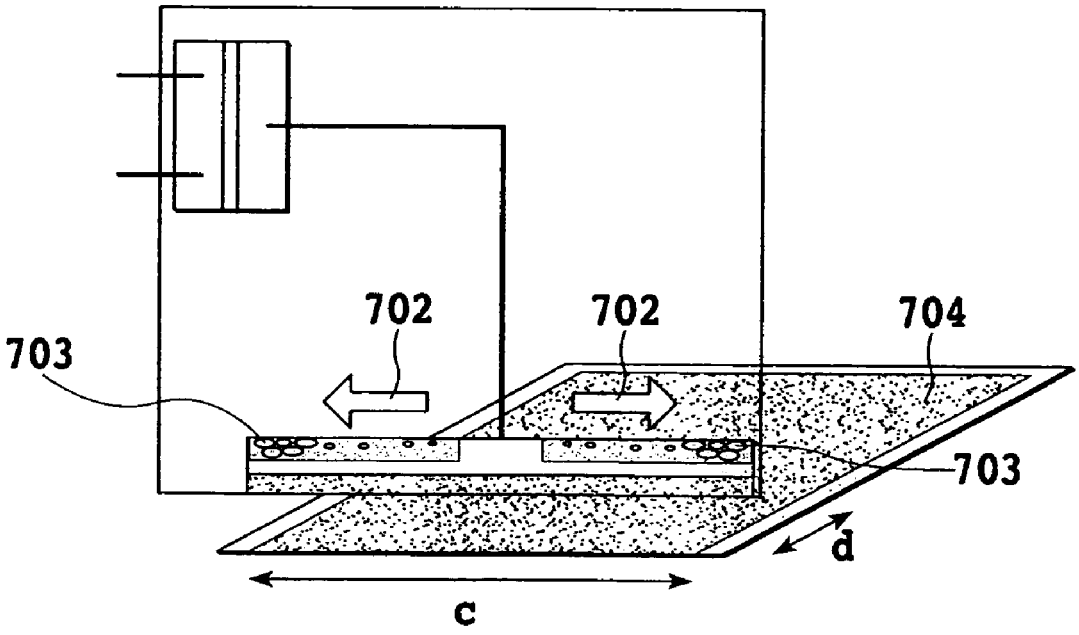
FIG. 7B is a schematic diagram showing how residual bubbles move along the flow of ink.

As shown in FIG. 7A and FIG. 7B, residual bubbles are less likely to accumulate at portions near the ink supply port and more likely to accumulate at end portions of a nozzle array. That is, ink supplied from the ink supply port flows in directions of arrows 702, so residual bubbles in those nozzles near the ink supply port are carried away by the ink flow. Therefore, residual bubbles in the nozzles near the ink supply port do not build up easily whereas residual bubbles are more likely to build up as the nozzles are farther away from the ink supply port.

To cope with this situation, this embodiment weights the accumulated ejection number according to the position of each block. The weighting values are determined based on experiments.

Figure 8A:
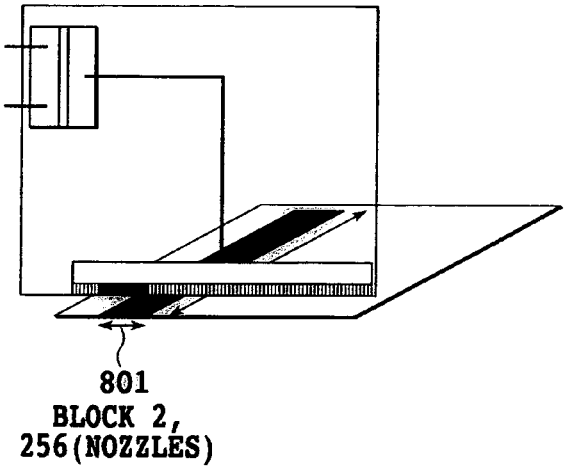
FIG. 8A is a schematic diagram showing how a printing is done by a nozzle block 2.
Figure 8B:
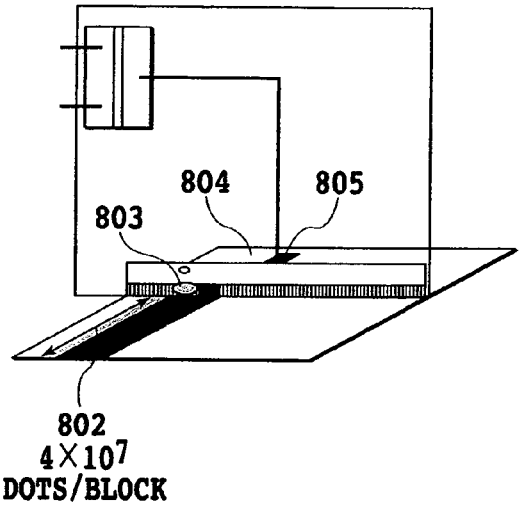
FIG. 8B is a schematic diagram showing a state in which residual bubbles are formed in the nozzle block 2.

FIG. 8A is a schematic diagram showing a test pattern for each block used in the experiment. FIG. 8B schematically shows a bubble being formed while a test pattern is printed.

As shown in these figures, in this embodiment each block has 256 nozzles and a test pattern 801 is printed using each of the nozzle blocks, only one block at a time. The test pattern is one-block (256-nozzle) wide and solidly printed by all 256 nozzles of each block. As the printing of this test pattern continues, residual bubbles gradually grow in these nozzles and at one point in time cause an ejection failure 804 which shows in a printed result of the test pattern. The ejection failure is observed in the form of, for example, a loss of print dots. The point in time when this ejection failure occurs is determined to be a printing limit. The printing limit for block 2, for example, is $4\times10^7$ (dots/block) as shown in FIG. 8B.

Figure 8C:
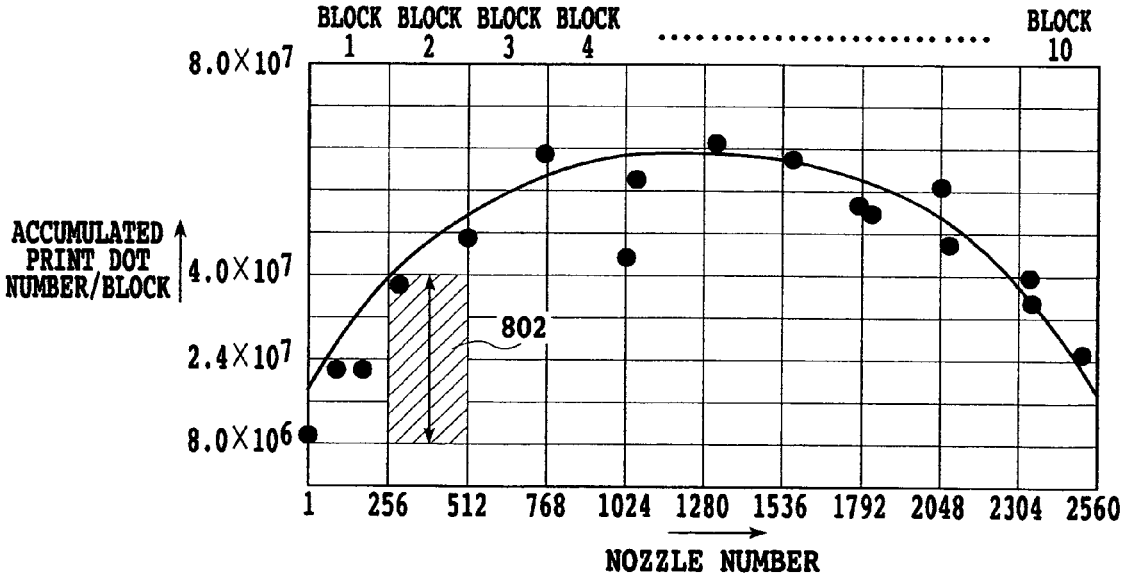
FIG. 8C is a graph showing a relation between the accumulated number of print dots for each nozzle block and a recovery operation condition.

FIG. 8C is a graph plotting a result of experiment, i.e., a printing limit for each block. As can be seen from this graph, when the ink supply port is located at a center of the print head, the printing limit becomes lower toward the ends of the print head. Based on the result of experiment, weighting values for individual blocks are determined.

In this embodiment, after the printing limit for one block is detected, residual bubbles in the print head are completely removed as by executing a preliminary ejection before proceeding to the next block for its printing limit. The test procedure is not limited to this and may be changed according to the construction of the print head.

Figure 9:
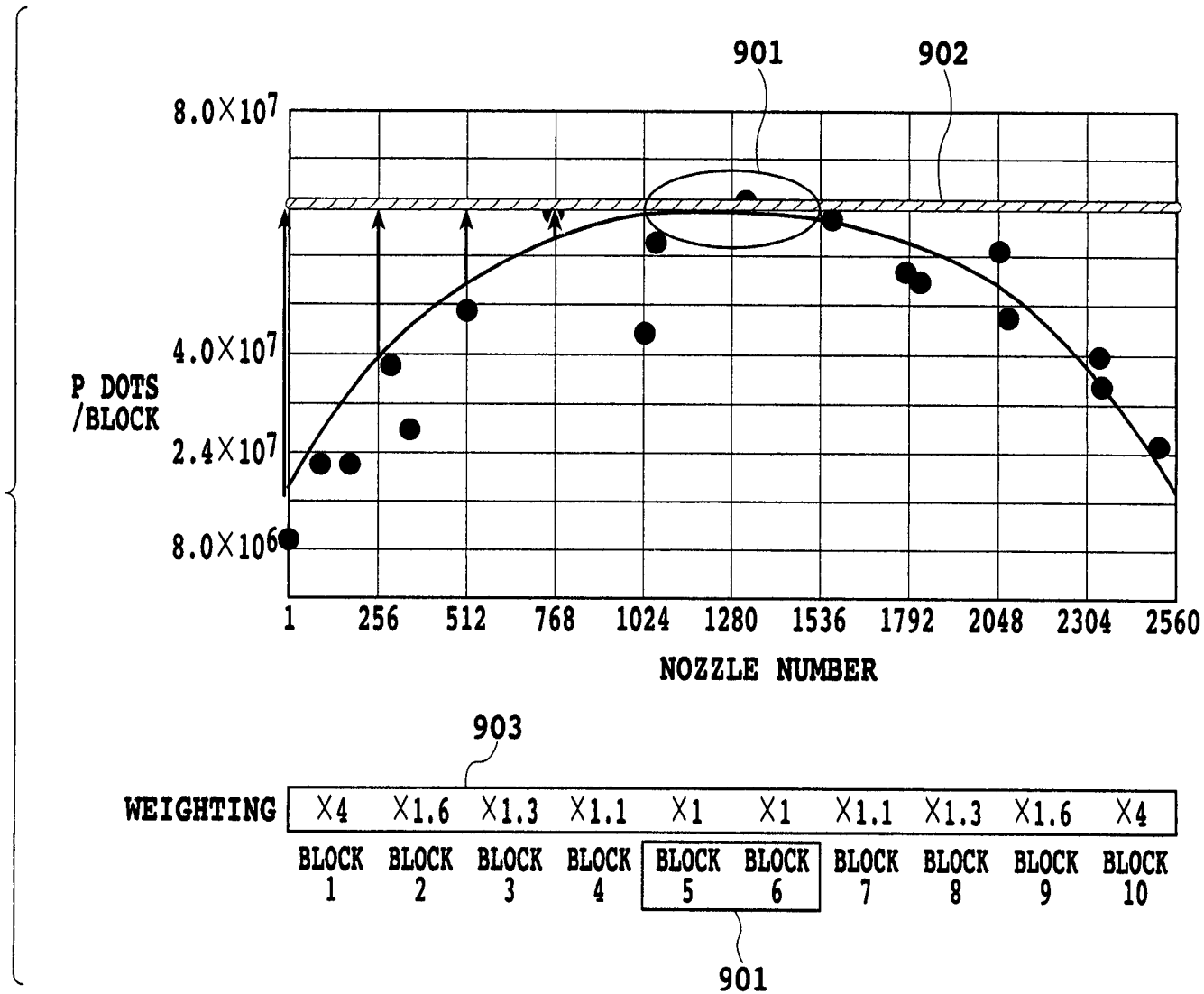
FIG. 9 is a diagram showing a relation between a weighting of the accumulated number of print dots and each nozzle block.

FIG. 9 illustrates a correspondence between the weighting values and the test result.

In this embodiment, the printing limit 902 for blocks 5, 6 situated closest to the ink supply port is used as a threshold for executing the recovery operation. For example, $2.0\times10^8$ is taken as a threshold Q. Since the threshold varies according to a type of print head, an appropriate threshold value can be determined by experiments.

Further, for block 1 and block 10 situated at the ends of the print head, a largest correction value of "×4" is used. In other words, when four times the accumulated number of ejections for block 1 or block 10 reaches the threshold, the recovery operation is initiated.

For block 5 or block 6 a correction value of "×1" is used. That is, when the accumulated number of ejections as is, with no correction value applied, reaches the threshold, the recovery operation is initiated.

As shown in FIG. 9, the weighting value for each nozzle block is set smaller as the block position approaches the ink supply port.

The weighting value can be changed according to the block construction. For example, in a configuration in which the nozzles are not equally divided into blocks, it is needless to say that a unique correction value is assigned to each block. In a configuration in which the accumulated number of ejections is counted for each nozzle, it is possible to assign unique correction values to individual nozzles or the same value to the nozzles in a predetermined region.

Next, a detailed flow of processing executed before the recovery operation is initiated will be explained in the following.

Figure 10A:
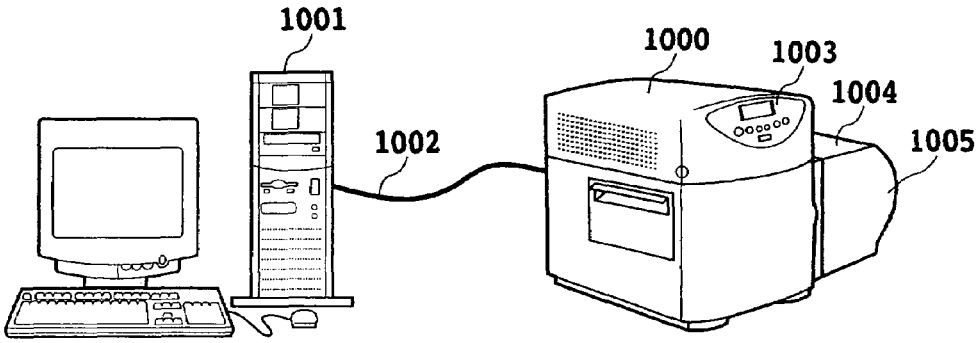
FIG. 10A is a schematic diagram showing a system configuration of an ink jet printing apparatus and a host computer.

FIG. 10A illustrates a system configuration including the ink jet printing apparatus of this invention and a host computer.

The host computer (also referred to as a "host PC") 1001 and the ink jet printing apparatus 1000 are connected to each other through an interface cable 1002. The host computer 1001 sends print data to the ink jet printing apparatus. Based on the print data received, the ink jet printing apparatus executes the printing operation.

Figure 10B:
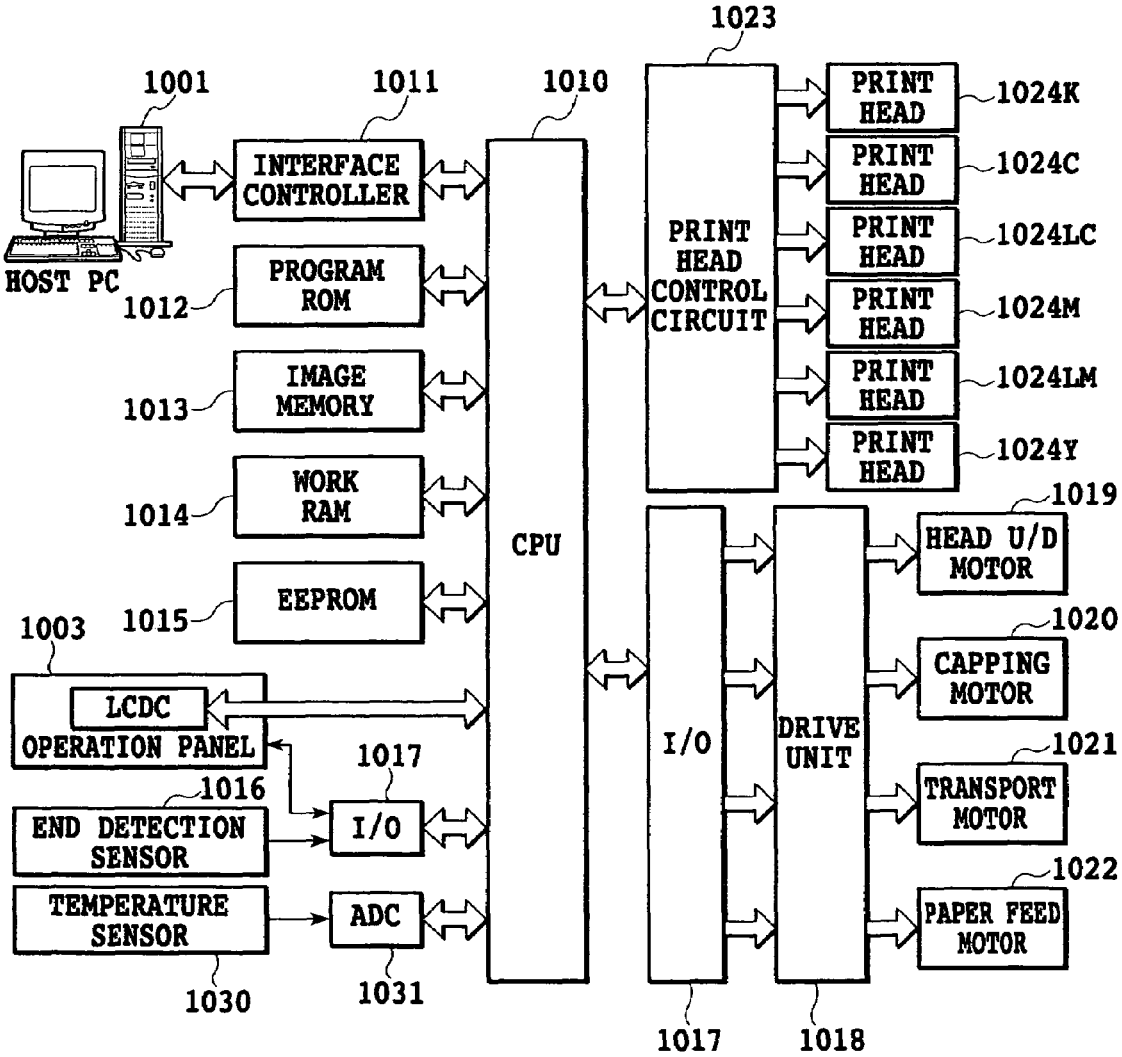
FIG. 10B is a block diagram showing an electrical configuration of an ink jet printing apparatus.

FIG. 10B is a block diagram showing an electrical configuration of the printing apparatus.

Denoted 1010 is a CPU controlling the entire ink jet printing apparatus.

More specifically, the CPU 1010 analyzes a command received from the host computer 1001 through an interface controller 1011 and bit-maps image data for each color component in an image memory 1013. Then, the CPU 1010 drives a capping motor 1020 and a print head U/D motor 1019 through an input/output port (I/O) 1017 and a drive unit 1018 to move the print heads 1024K–1024Y from the capping position (standby position) to a print position. Further, the CPU 1010 drives a paper feed motor 1022 for feeding a print medium 1005 and a transport motor 1021 for driving a paper transport unit (not shown) in the printing apparatus body to continuously transport the print medium 1005 (at a constant speed).

Further, to determine a print start timing at which the print medium 1005 being transported should begin to be printed, a front end detection sensor 1016 is used to detect a front or rear end of the print medium.

Then, in synchronism with the paper feeding by the transport motor 1021, the CPU 1010 reads the bit-mapped image data of different colors from the image memory 1013 and transfers them through a print head control circuit 1023 to the print heads 1024K–1024Y, each of which then selectively activates nozzles, based on the received bit-mapped image data of the associated color, to eject ink and thereby form a color image.

The print heads 1024K–1024Y provided in the printing apparatus 1000 are line heads which, during a printing operation, are kept stationary with the print medium 1005 fed at a constant speed of, for example, 100 [mm/sec].

The operation of the CPU 1010 is executed according to a program stored in a program ROM 1012. The program ROM 1012 stores a program, a reference table and other information. The control flow and the program will be explained later.

The CPU 1010 uses a work RAM 1014 as a work area when executing processing.

An EEPROM 1015 is a nonvolatile memory to store parameters characteristic of the printing apparatus, including one representing minute printing position adjustments among the print heads.

The print head control circuit 1023 reads bit-mapped print data for each color at high speed from the image memory 1013 through a bus arbitration circuit (not shown) and transfers the print data to, for instance, six line print heads 1024K–1024Y through independent print data transfer lines and data clock lines.

The line print heads are assigned different colors, black 1024K, cyan 1024C, light cyan 1024LC, magenta 1024M, light magenta 1024LM, and yellow 1024Y. These color inks are ejected from the individual heads to form a color image.

Since the print data output from the print head control circuit 1023 through the print data transfer lines is transferred in the form of binary data for each pixel (1: to be printed, 0: not to be printed), the print data can be counted in units of dots (pixels).

Figure 11:
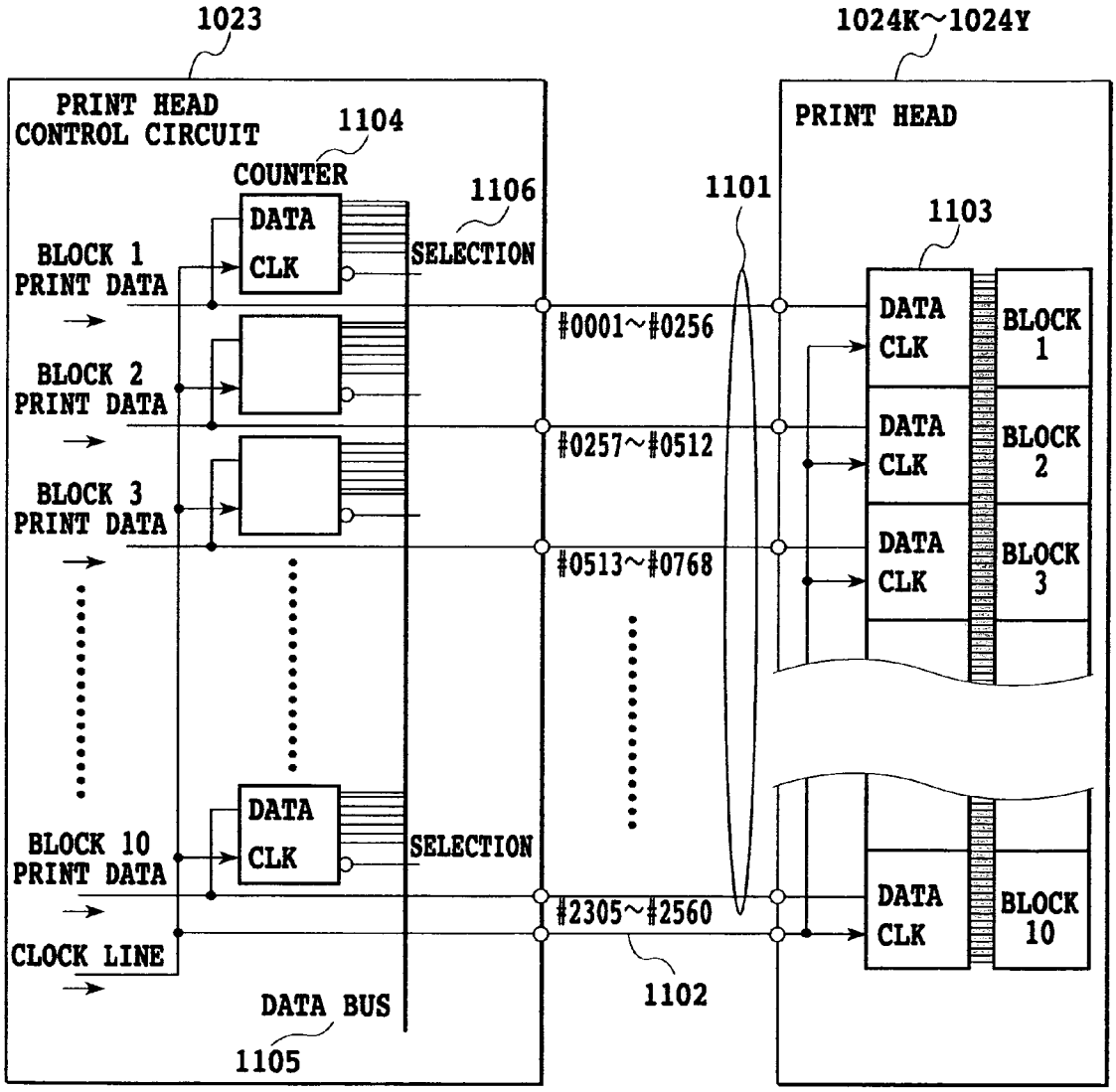
FIG. 11 is a diagram showing a dot counter in this embodiment.

A method of counting the accumulated number of dots for each print head according to this invention will be explained by referring to FIG. 11.

In this embodiment, 10 print data transfer lines and 10 clock lines are provided between the print head control circuit 1023 and the print heads 1024K–1024Y.

The print heads 1024K–1024Y are line heads about 4.3 inches wide, each of which has a resolution of 600 [dots/inch] and 2560 nozzles.

In each print head the 2560 nozzles are divided into 10 blocks of 256 nozzles, each block being assigned one print data transfer line 1101.

The clock (CLK) line 1102 is a shift clock to convert the serially transferred print data into a parallel drive signal by a shift register 1103 in the print head.

The print head control circuit 1023 incorporates accumulated print dot counters (accumulated ejection number counters) 1104 one for each block.

In this embodiment, there are six print heads 1024K–1024Y each having 10 nozzle blocks, so the print head control circuit 1023 has a total of 60 accumulated print dot counters 1104.

Each counter has, for example, 32 [bits] and thus an upper limit of the accumulated print dot number that can be counted by the counter is $$2^{32}=4.2949672\times10^{9}[\text{dots}].$$

The accumulated print dot counters 1104 are normally built into registers and, when a selection line 1106 is accessed, the counter output values are taken into the registers, so that the CPU 1010 can read the counter output values through a data bus 1105 at any time.

It is noted that there is no problem in practical use if only higher 16 bits (or higher n bits), for example, of an output of each accumulated print dot counter 1104 are made valid for reading with the remaining lower bits not read.

Now, in the above configuration a flow of processing leading up to the initiation of the recovery operation will be explained.

Figure 12:
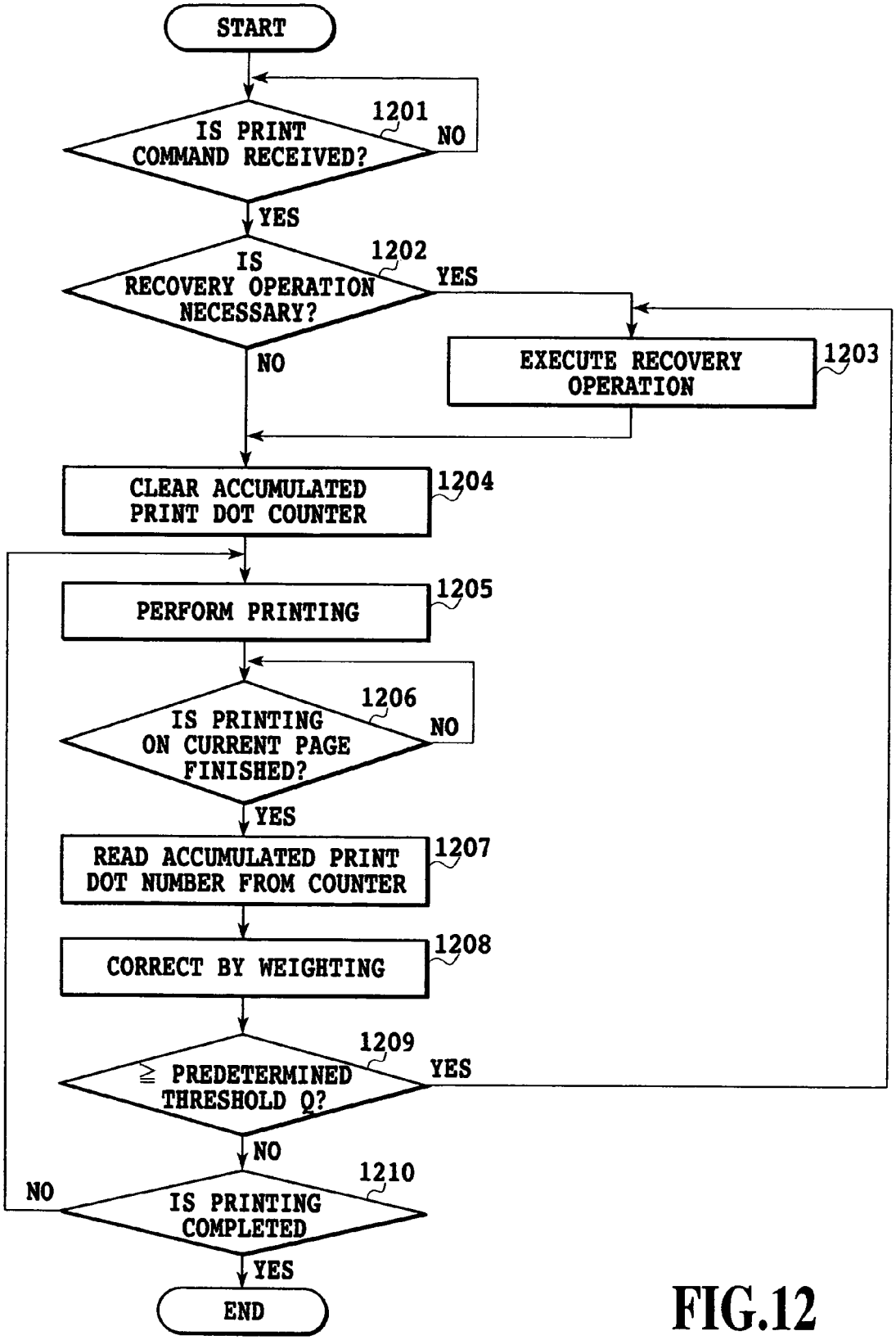
FIG. 12 is a flow chart showing a sequence of steps performed in counting the number of print dots and in executing recovery operation.
Figure 14:
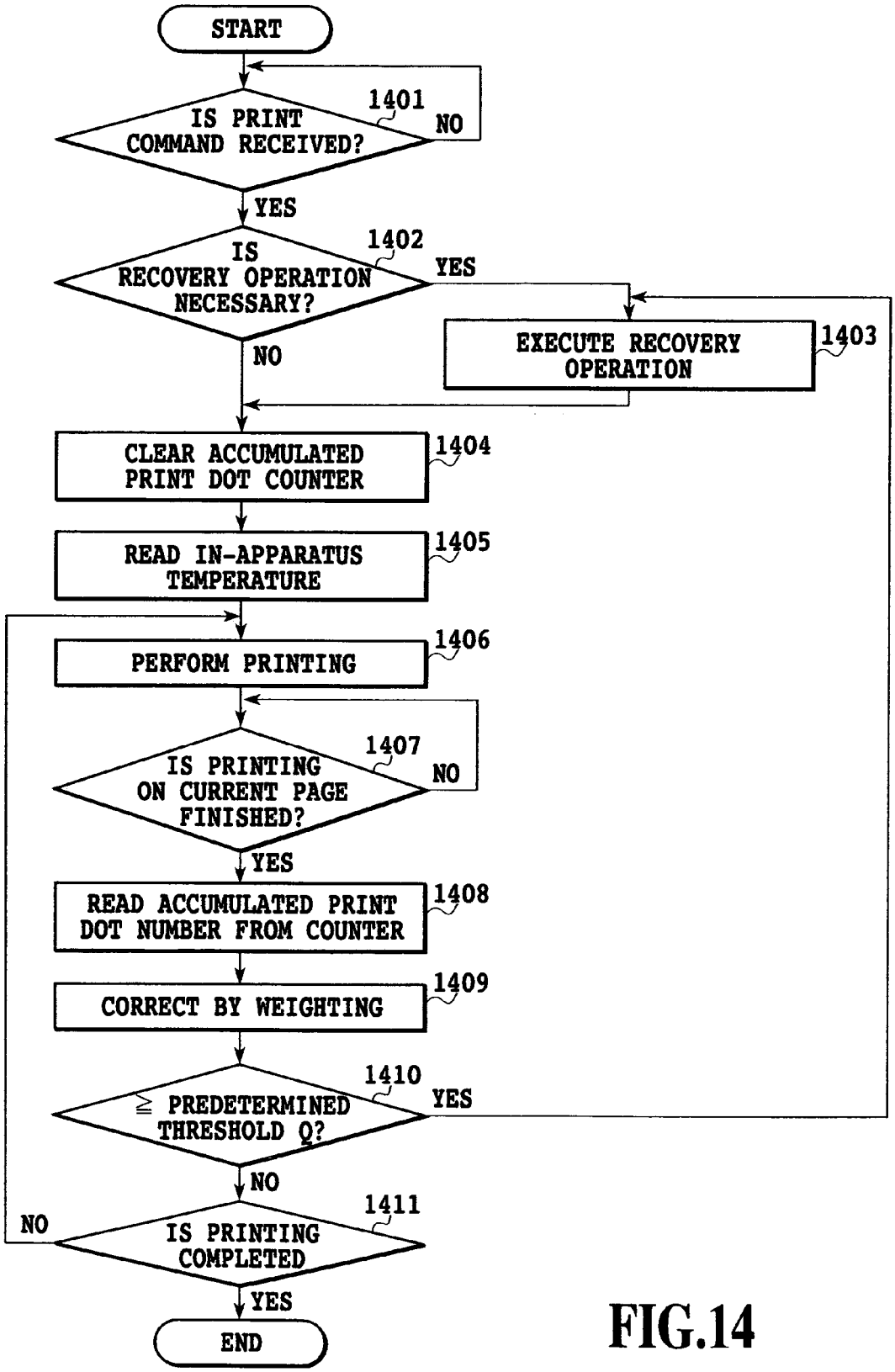
FIG. 14 is a flow chart showing a sequence of steps performed in counting the number of print dots and in executing recovery operation in the second embodiment.

FIG. 12 is a flow chart showing a sequence of steps from the reception of a print command to the execution of a recovery operation and the completion of a printing operation.

First, print data and a print command are output from the host computer and, when the CPU receives them (step 1201), it checks whether a recovery operation on the print head needs to be performed (step 1202). This decision is made by checking if a certain period of time, for instance 48 hours, has passed after the last recovery operation. With an elapse of many hours after the last use of the printing apparatus, there is a possibility that ink may be adhering to areas around the nozzles and it is necessary to remove the viscous ink.

If it is decided that the recovery operation needs to be performed, the recovery operation is executed (step 1203). More specifically, all the nozzles are subjected to preliminary ejections. If the recovery operation is found not necessary, the program moves to the next step. Then, an accumulated print dot counter value for each block is cleared to zero (step 1204).

Then, a printing operation is initiated according to print data (step 1205) and at the same time the accumulated print dot counters are started. When one page of printing is completed (step 1206), the accumulated print dot number in each counter is read out for each block (step 1207) and multiplied by the corresponding weighting value (step 1208). The multiplied values are then compared with a predetermined threshold Q (step 1209). If there is any block that has exceeded the threshold, it is decided that there is a possibility of a printing failure being caused by the growth of residual bubbles and thus a recovery operation is executed (step 1203). In the recovery operation, all nozzles perform preliminary ejections.

The weighting values are values that are experimentally obtained for the nozzle blocks of the print head 104, as explained in connection with FIG. 9, and are stored in a reference table area in the program ROM.

After the recovery operation is finished, the program returns to step 1204 where it clears the values of the accumulated print dot counters before proceeding to print the next page. If, on the other hand, none of the weighted, accumulated print dot numbers for the nozzle blocks exceed the threshold Q, the program returns to step 1205 where it resumes the printing operation until all the print data received is printed out (step 1210).

As described above, counting the accumulated number of print dots for each block and executing the recovery operation when one of the accumulated print dot numbers reaches a predetermined threshold enables the recovery operation to be performed always at an appropriate timing for a variety of print patterns, including those that activate only a part of the nozzles.

Further, by correcting the weighting values according to the blocks' positions, the recovery operation can be executed always at an appropriate timing even if, depending on the structure of the print head, some nozzles in the print head tend to build up bubbles and some do not.

With the recovery operation execution timing determined in this manner, it is possible to reduce the number of recovery operations and therefore a wasteful consumption of ink, compared with the prior art which determines the execution timing based on a worst case scenario.

(Embodiment 2)

Our experiments have found that the generation of residual bubbles is also influenced by an ink temperature. One of possible causes for this phenomenon is the fact that as the ink temperature increases, a gas dissolved in ink is precipitated and combines with the residual bubbles, which means that the residual bubbles grow faster than when the temperature is low. For this reason, the higher the ink temperature, the earlier the residual bubbles grow and the earlier the recovery operation needs to be performed.

The ink temperature varies depending on a temperature of an environment in which the printing apparatus is installed and also on a duration of the printing operation. Since the ink temperature is difficult to measure directly, this embodiment provides a temperature sensor in the ink jet printing apparatus and corrects the weighting value according to the measured temperature from the sensor.

FIG. 13 is a table of weighting values according to a temperature in the apparatus. The weighting values are largest when the in-apparatus temperature is 30 degrees Celsius or higher. This table is stored in the program ROM as in Embodiment 1.

Next, a flow of processing using this weighting table and leading up to the initiation of the recovery operation will be explained.

Upon receiving a print operation command from the host computer (step 1401), the CPU checks whether a recovery operation on the print head needs to be performed (step 1402). This decision is made by checking if a certain period of time, for instance 48 hours, has passed after the last recovery operation. With an elapse of many hours after the last use of the printing apparatus, there is a possibility that ink may be adhering to areas around the nozzles and it is necessary to remove the viscous ink.

If it is decided that the recovery operation needs to be performed, the recovery operation is executed (step 1403). More specifically, all the nozzles are subjected to preliminary ejections. If the recovery operation is found not necessary, the program moves to the next step. Then, an accumulated print dot counter value for each block is cleared to zero (step 1404).

Next, the CPU reads an output of a temperature sensor 1030 (see FIG. 10B) through an AD converter (ADC) 1031 and determines an in-apparatus temperature using a temperature conversion table (not shown) (step 1405).

Then, the CPU starts printing (step 1406) and, when one page of printing is finished (step 1407), it reads out the accumulated print dot counter value for each block (step 1408). The accumulated print dot number for each block is multiplied by the weighting value selected from the table of FIG. 13 which corresponds to the in-apparatus temperature obtained in step 1045 (step 1409). Then a check is made to see if there is any block whose multiplied result is in excess of a predetermined threshold Q (step 1410). If such a block exists, the CPU decides that there is a high possibility of an ejection failure being caused by residual bubbles and returns to step 1403 where it executes the recovery operation. After the recovery operation is finished, the CPU returns to step 1404 where it starts the printing operation again. If, on the other hand, none of the weighted, accumulated print dot numbers exceed the threshold, the CPU returns to step 1406 where it resumes the printing operation. The above process is continued until all the print data received is printed out (step 1411).

Although, in the above embodiments, the accumulated ejection number has been described to be counted for all nozzle blocks of the print head, it is possible to count the accumulated ejection number for only a part of the blocks and, when one of the count values reaches a predetermined threshold, to initiate the recovery operation. For example, the counting can be done for only those blocks where bubbles easily build up and still the similar effect can be produced.

As described above, with this invention, the number of recovery operations that need to be performed to avoid ejection failures caused by the growth of residual bubbles that develop in the print head during the printing operation can be made smaller than that required by the prior art. This can shorten the time it takes to complete the printing operation. In addition, since the recovery operation can be executed at an appropriate timing, a good printed result can be obtained at all times without causing image degradations due to ejection failures. Further, the reduced number of recovery operations performed ensures a reduction in the consumption of ink.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing apparatus to form an image on a print medium by ejecting ink onto the print medium from a plurality of nozzles arrayed in a print head, the printing apparatus comprising:

recovery means to recover a normal ink ejection state of each nozzle in the print head;

recovery operation determining means for dividing the nozzles into a plurality of blocks, the nozzles divided into the plurality of blocks forming a nozzle array, the plurality of blocks being divided in a length direction of the nozzle array, counting the number of ejections from the nozzles in each block and, based on the accumulated number of ejections for each block, determining whether or not to execute a recovery operation of said recovery means, wherein said recovery operation determining means determines to execute the recovery operation on the print head when at least one of the accumulated numbers of ejections for the individual blocks reaches a predetermined threshold; and accumulated ejection number correction means to correct by a weighting value the accumulated number of ejections counted for each block, wherein said recovery operation determining means compares the accumulated numbers of ejections corrected by said accumulated ejection number correction means with the predetermined threshold, and wherein said accumulated ejection number correction means increases the weighting value as the position of the associated nozzle block is farther away from an ink supply port of the print head and multiplies the accumulated number of ejections by the associated weighting value to correct the accumulated number of ejections.

2. An ink jet printing apparatus, to form an image on a print medium by using a print head, wherein the print head includes a plurality of nozzles for ejecting ink, an ink supply port to receive a supply of ink, a liquid chamber to deliver the supplied ink to the nozzles, and a plurality of nozzle heaters provided one in each nozzle to heat the ink and thereby form a bubble in ink in each nozzle to eject the ink by a pressure of the expanding bubble, the printing apparatus comprising:

print head recovery means to recover a normal ink ejection state of each nozzle in the print head;

recovery operation determining means for determining whether or not to execute a recovery operation of said print head recovery means; and an accumulated print dot number counter to divide the nozzles of the print head into a plurality of blocks, the nozzles divided into the plurality of blocks forming a nozzle array, the plurality of blocks being divided in a length direction of the nozzle array, and count the accumulated number of print dots for each block, wherein said recovery operation determining means determines, based on a value of said accumulated print dot number counter, whether or not to execute the recovery operation, and wherein a target accumulated print dot number, on which is based a decision to execute the recovery operation, is set large for blocks near the ink supply port.

3. An ink jet printing apparatus comprising:

print head recovery means to recover a normal ink ejection state of each nozzle in a print head;

memory means to store an accumulated number of print dots printed by each of the nozzles; and recovery operation determining means for setting different target print dot numbers to different nozzles and checking if the accumulated number of print dots printed by each of the nozzles has reached the corresponding target print dot number, in order to determine whether or not to execute a recovery operation of said print head recovery means, wherein the target print dot number, on which is based a decision to execute the recovery operation, is set large for nozzles near an ink supply port.

4. An ink jet printing apparatus comprising:

print head recovery means to recover a normal ink ejection state of each nozzle in a print head;

memory means to store an accumulated number of print dots printed by each of the nozzles; and recovery operation determining means for setting different target print dot numbers to different nozzles and checking if the accumulated number of print dots printed by each of the nozzles has reached the corresponding target print dot number, in order to determine whether or not to execute a recovery operation of said print head recovery means, wherein the target print dot number, on which is based a determination to execute the recovery operation, is set large for a central portion of the print head and small for end portions of the print head.

* * * * *